US010017973B2

(12) United States Patent
Höschler et al.

(10) Patent No.: US 10,017,973 B2
(45) Date of Patent: Jul. 10, 2018

(54) HINGE FOR UNHINGEABLE SHEET-METAL CABINET DOORS

(71) Applicant: DIRAK Dieter Ramsauer Konstruktionselemente GmbH, Ennepetal (DE)

(72) Inventors: Peter Höschler, Velbert (DE); Friedrich Rinke, Hemer-Ihmert (DE); Dieter Ramsauer, Schwelm (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 0 days.

(21) Appl. No.: 15/555,735

(22) PCT Filed: Mar. 1, 2016

(86) PCT No.: PCT/EP2016/000349
§ 371 (c)(1),
(2) Date: Sep. 5, 2017

(87) PCT Pub. No.: WO2016/142040
PCT Pub. Date: Sep. 15, 2016

(65) Prior Publication Data

US 2018/0044957 A1 Feb. 15, 2018

(30) Foreign Application Priority Data

Mar. 12, 2015 (DE) ..... 20 2015 001 918 U

(51) Int. Cl.
*E05D 7/10* (2006.01)

(52) U.S. Cl.
CPC ..... *E05D 7/1066* (2013.01); *E05Y 2600/53* (2013.01); *E05Y 2800/26* (2013.01); *E05Y 2900/208* (2013.01); *Y10T 16/53615* (2015.01)

(58) Field of Classification Search
CPC ..... E05D 7/1066; E05D 7/10; E05D 7/1055; E05D 7/123; E05D 2007/128;
(Continued)

(56) References Cited

U.S. PATENT DOCUMENTS 437,492 A 9/1890 Herrick
2,778,053 A * 1/1957 Hess ..... E05D 7/1061 16/258
(Continued)

FOREIGN PATENT DOCUMENTS

DE 87 00 368 5/1988
WO WO 2005/083207 9/2005

OTHER PUBLICATIONS

Catalogue of The DIRAK—system functionality and design, "*Innovative Locking and latching-system for electrical and industrial enclosures*", DIRAK—GmbH & Co. KG, Kaiserstraße 55-59, 58332 Schwelm, p. 4-125, publication date Mar. 1996.
(Continued)

*Primary Examiner* — William Miller
(74) *Attorney, Agent, or Firm* — Haug Partners LLP

(57) ABSTRACT

A hinge for unhingeable sheet-metal cabinet doors. A first hinge part, to be fastened to the door frame, has a bore hole or roll at a free end, through which a hinge pin extends. A second, U-shaped hinge part is connected to the door and surrounds the exposed end areas of the hinge pin in the mounted position. The U-shaped hinge part surrounds the first hinge part with first U-legs. The U-shaped hinge part includes a top part arranged in a bottom part. The top part has the shape of a U-shaped slide, with second U-legs, arranged to be displaceable between two end positions parallel to the extension of the first U-legs. The ends of the second U-legs close a lateral outlet opening for the hinge pin end in one end position, and expose the opening, through
(Continued)

which the hinge pin end passes laterally, in the other end position.

6 Claims, 5 Drawing Sheets

(58) Field of Classification Search
CPC ..... E05Y 2600/53; E05Y 2800/26; E05Y 2900/208; Y10T 16/5358; Y10T 16/535; Y10T 16/5353; Y10T 16/528; Y10T 16/5285; Y10T 16/527
USPC ..... 16/258, 254, 255, 231, 232, 229
See application file for complete search history.

(56) References Cited

U.S. PATENT DOCUMENTS 2,913,200 A * 11/1959 Paine, Jr. ..... F16M 5/00 16/258
3,406,995 A * 10/1968 McCarthy ..... E05D 7/1077 16/258
4,495,672 A * 1/1985 Adams ..... E05D 7/1011 16/229
4,873,745 A * 10/1989 Ramsauer ..... E05D 7/10 16/258

OTHER PUBLICATIONS

International Search Report PCT/EP2016/000349 dated May 13, 2016.

* cited by examiner

Fig. 2C1

HINGE FOR UNHINGEABLE SHEET-METAL CABINET DOORS

The present application claims priority from PCT Patent Application No. PCT/EP2016/000349 filed on Mar. 1, 2016, which claims priority from German Priority Application No. 20 2015 001 918.8 filed on Mar. 12, 2015, the disclosures of which are incorporated herein by reference in their entirety.

FIELD OF THE INVENTION

It is noted that citation or identification of any document in this application is not an admission that such document is available as prior art to the present invention.

The invention is directed to a hinge for unhingeable sheet-metal cabinet doors, comprising a first hinge part which can be fastened to the door frame and which forms at its free end a bore hole or roll through which a hinge pin extends and is held in the center or which can also be formed in one piece and a second, U-shaped hinge part which is connected to the door and surrounds the exposed end areas of the hinge pin in the mounted position, wherein the one hinge part which is U-shaped surrounds the other hinge part with the U-legs.

A hinge of this type is already known from page 4-125 of the catalogue of DIRAK GmbH & Co. KG, Kaiserstraβe 55-59, 58332 Schwelm, publication date March 1996.

In order to separate the door from the frame, it is necessary to pull the hinge pin of both hinges out of the hinge parts, which is complicated. A further aspect concerns the possibility of producing a ground connection between the door leaf and the door frame, which is possible in principle in the case of the catalogue version because the two hinge parts and the pin are made of steel, i.e., of a conductive metal. However, it is uncertain that contact will be made between the hinge pins and the two hinge parts which move relative to one another when the door is opened or closed.

SUMMARY OF THE INVENTION

The object of the invention is to provide a hinge which allows the door to be separated from the door frame, while a secure ground connection can be produced at the same time.

The above-stated object is met in that the U-shaped hinge part comprises a bottom part and a top part, wherein the top part is arranged so as to be displaceable between two end positions parallel to the extension of the U-legs in the bottom part in the form of a likewise U-shaped slide, wherein the ends of the legs close an outlet opening for the end of the pin in the one end position, but release an opening through which the end of the hinge pin can slide laterally in the other end position and when the door is open.

On the one hand, a hinge configured in this way allows a separation of door and door frame without having to pull out the hinge pin. Rather, the hinge pin remains in the bore hole or in the roll of the first hinge part so that a reliable ground can be produced in addition.

According to a further development of the invention, the two end positions of the slide are defined by a spring-loaded ball.

According to another further development of the invention, the through-opening has a contour such that the hinge pin is allowed to pass through only when the door is open so as to eliminate the risk of the door leaf unintentionally disengaging from the hinge.

According to another further development of the invention, the pin rests on an oblique plane formed by the bottom part, and the contact point or contact line between the pin and the oblique plane is under spring pressure. This ensures a reliable contact between the pin of the one hinge part and the oblique plane of the bottom part and, therefore, of the other hinge part.

According to another further development of the invention, the spring pressure is generated by a ball which is arranged in the bottom part and provided with a compression spring, wherein the ball is supported on an oblique plane formed by the top part. Here again, the contact between the ball and the oblique surface which is formed at the top part and where the ball is supported is ensured by the pressure of the compression spring.

The ball which is arranged in the bottom part and provided with the compression spring is identical to the ball defining the end positions, which economizes on material and also minimizes space requirements.

As in the prior art, the hinge parts are made of metal and can be fastened by means of screws to the door frame and door, respectively, particularly at the bevel area thereof.

According to an alternative, the hinge parts can also be made of metal and the fastening of the hinge parts can be fastened by means of snap fasteners with grounding spring.

The top part can have an easy-to-grip surface to facilitate displacement by the thumb and/or index finger of the operator.

BRIEF DESCRIPTION OF THE DRAWINGS

The invention will be described in more detail in the following with reference to embodiment examples which are shown in the drawings.

The drawings show:

FIG. 2C1 shows how pin 20 of hinge 10 rests on an oblique plane 56 formed by the bottom part 28.

DETAILED DESCRIPTION OF EMBODIMENTS

Figure 1A:
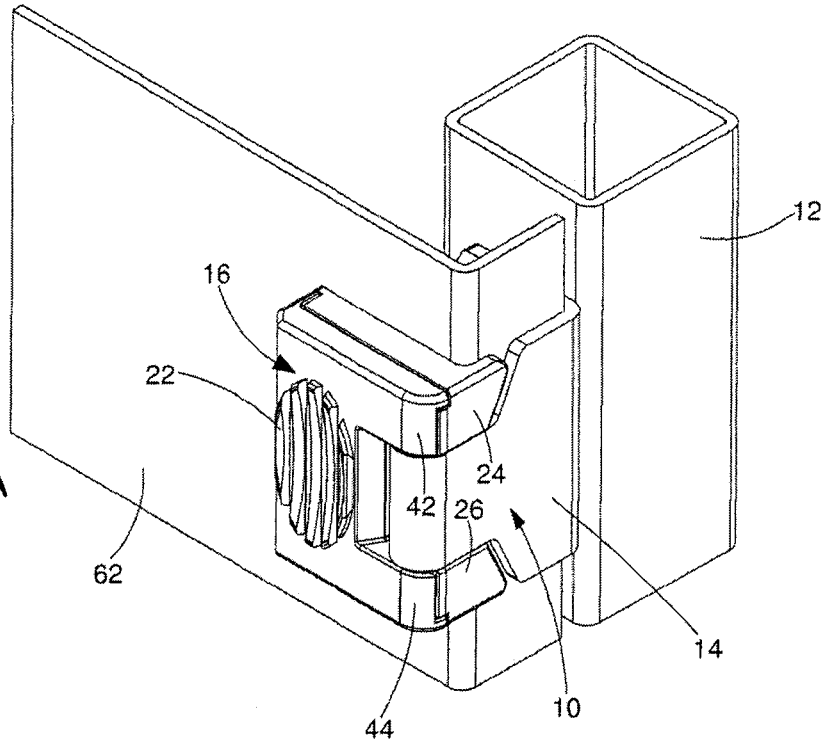
FIG. 1A shows a perspective view of the hinge according to the invention in locked position for contacting parts.
Figure 1B:
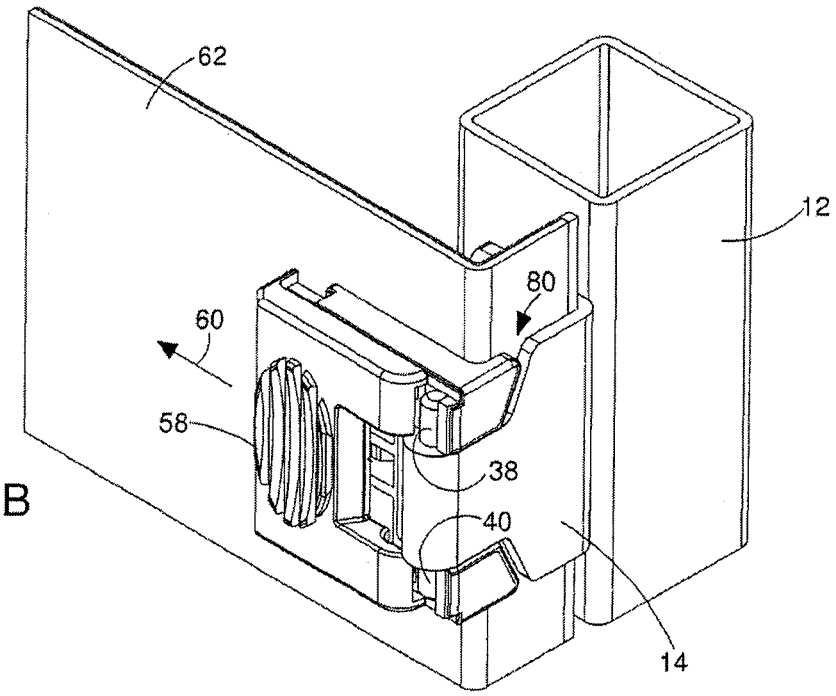
FIG. 1B shows the same view as in FIG. 1A but in which the slide is pushed into the unlocked position, but the door has not yet been swiveled open.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

FIG. 1 shows a perspective view of a hinge 10 constructed according to the invention, comprising a first hinge part 14 (see also FIG. 1D) which can be fastened to the door frame 12 and which forms at its free end a bore hole or roll 18 through which a hinge pin 20 extends and is held in the center and a second, U-shaped hinge part 16 which is connected to the door 62. The one hinge part which is U-shaped, e.g., the second hinge part, surrounds the other hinge part, e.g., the first hinge part, with the U-legs. The U-legs are designated by reference numerals 24 and 26 and are connected to one another by a U-bar 22. The U-shaped hinge part 16 comprises a bottom part 28 and a top part 30. The top part 30 is received in the bottom part 28 in the form of a slide 32 which is likewise U-shaped, which slide 32 is displaceable between two end positions 34, 36 (see FIG. 2A for the open position and FIG. 2B for the closed position). The displacement takes place parallel to the extension of U-legs 24, 26. In the one end position, the ends of the U-legs 42, 44 close a lateral outlet opening 38 for the end of pin 46 and 48, respectively; however, in the other end position and when the door is open, an opening 38, 40 through which the end of hinge pin 46, 48 can slide laterally is released.

The two end positions 34 and 36 of the slide 32 are defined by a spring-loaded ball 52 (see spring 50).

Figure 1C:
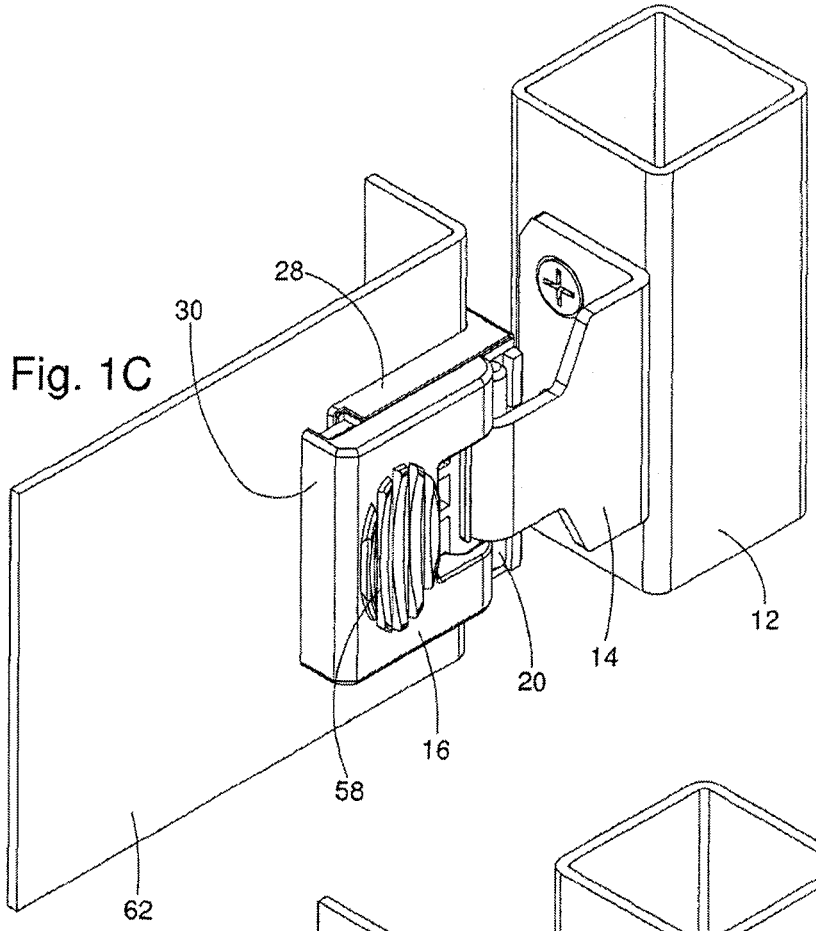
FIG. 1C shows a different viewing direction of the hinge according to the invention, but moved into the open position and additionally with the door swiveled open.
Figure 1D:
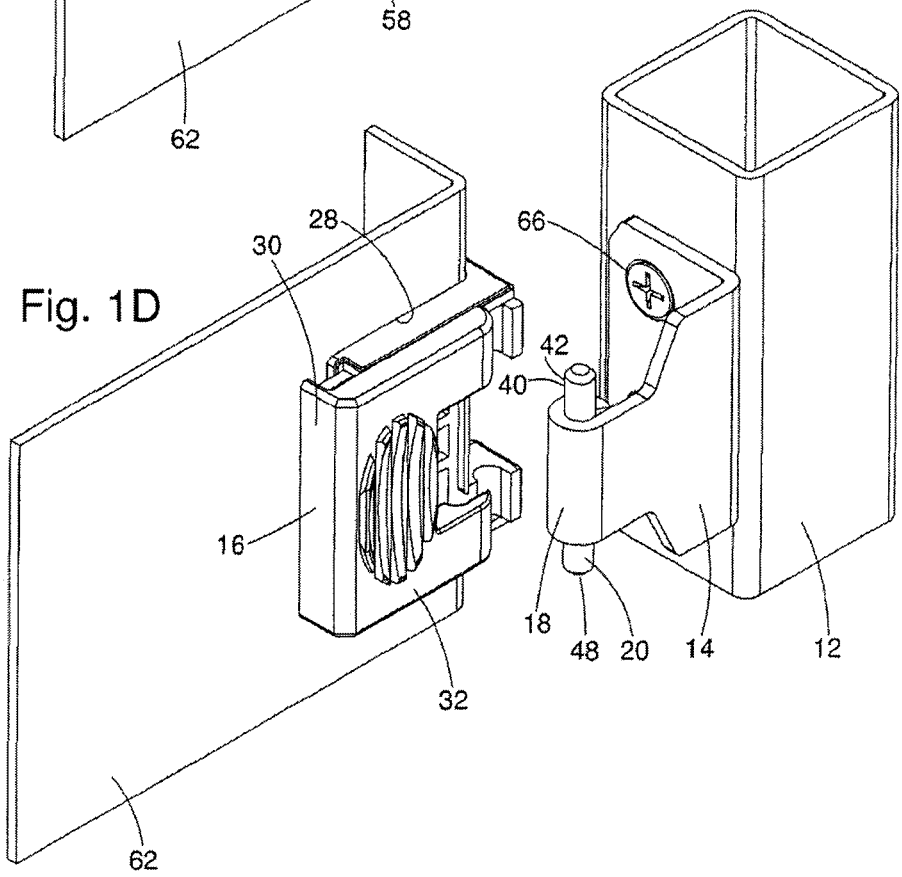
FIG. 1D shows the two hinge parts fastened to the door frame and door, respectively, after separation of the hinge parts and door at the door leaf.
Figure 2A:
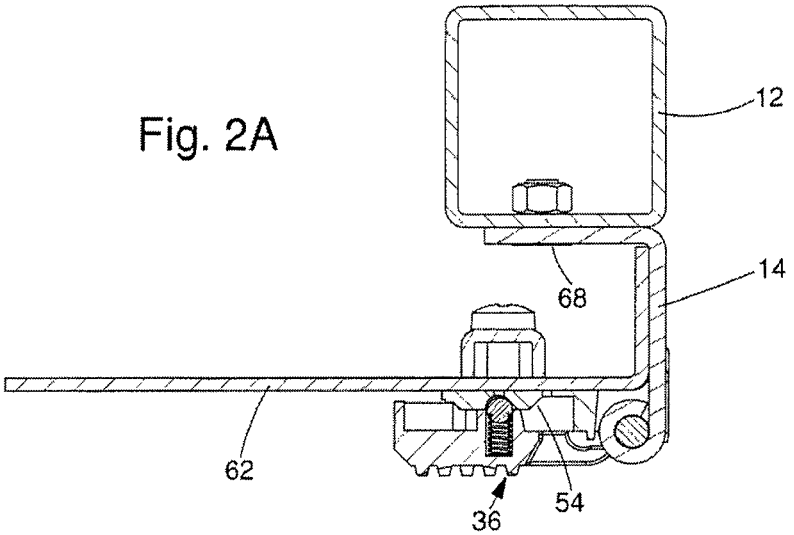
FIG. 2A shows a cross-sectional view through the arrangement according to the invention for doors located in the frame through the fastened hinge, wherein the hinge is closed and the door is in the closed position.
Figure 2B:
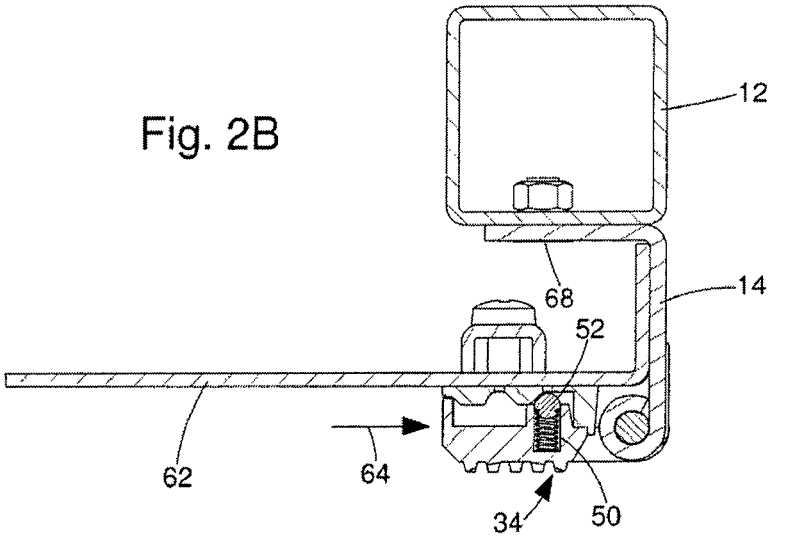
FIG. 2B shows the open position of the hinge with closed door.
Figure 2B:
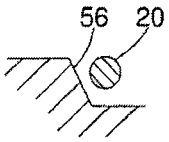
Figure 2C:
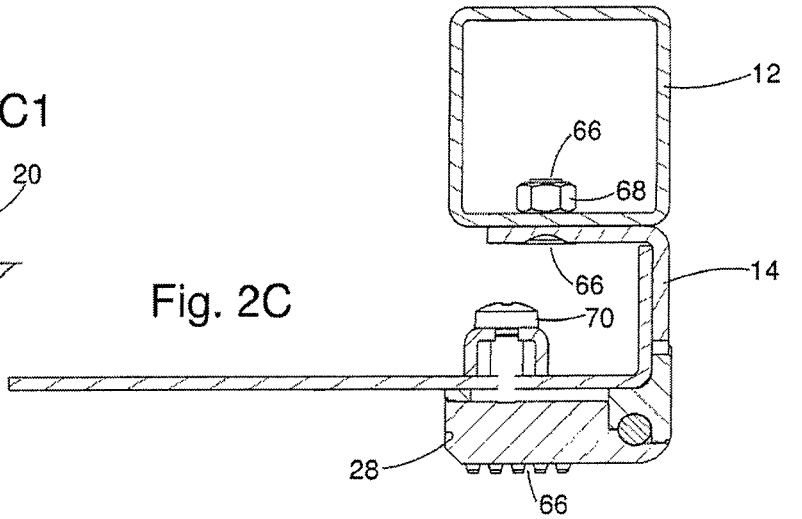
FIG. 2C shows a cross-sectional view through the center of the hinge.
Figure 2D:
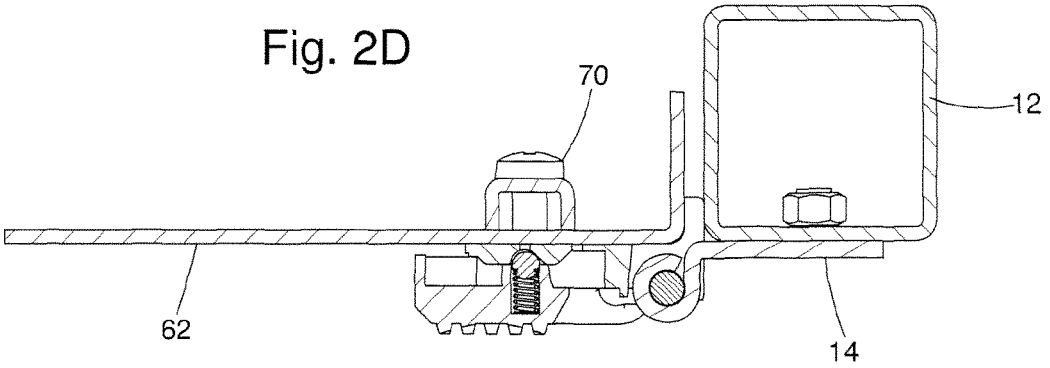
FIG. 2D shows a view similar to FIG. 2A for a different fastening to the door frame.
Figure 3:
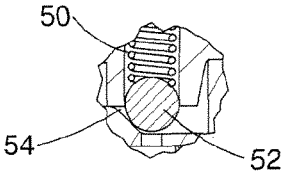
FIG. 3 shows a cross-sectional view through the hinge to show the shape of the hinge pin on the oblique surface.
Figure 2E:
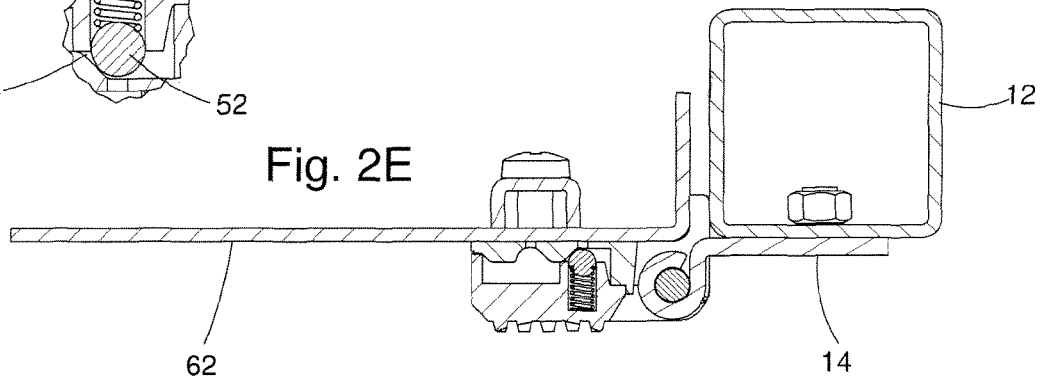
FIG. 2E shows corresponding to FIG. 2B.
Figure 2F:
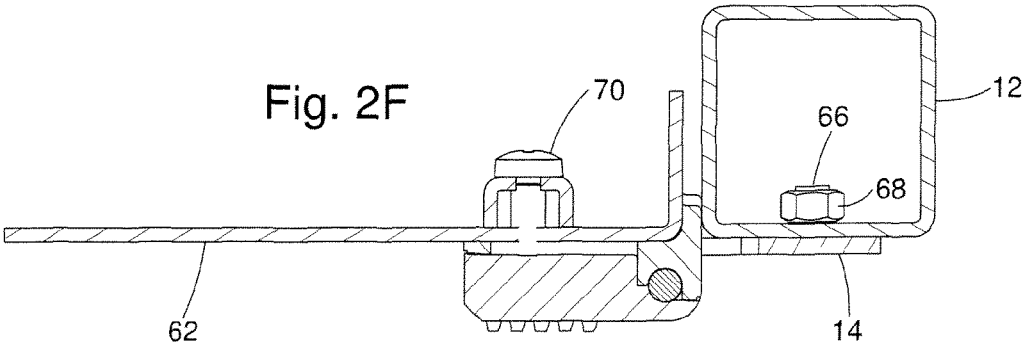
FIG. 2F shows corresponding to FIG. 2C.

FIG. 2C1 shows how pin 20 of hinge 10 rests on an oblique plane 56 formed by the bottom part 28, the contact point or contact line between the hinge pin 20 and the oblique plane 56 being under spring pressure. This spring pressure is generated by a ball 52 which is arranged in the bottom part 28 and provided with a compression spring 52, the ball 52 being supported on an oblique plane formed by the top part 30 as can be seen in FIG. 3. To facilitate construction, it is provided that the ball arranged in the bottom part and provided with compression spring 60 is identical to the ball defining the end positions. In order to achieve sufficient strength and electrical conductivity, the hinge parts are made of metal and are fastened to the door frame and door, respectively, by screws.

Figure 5A:
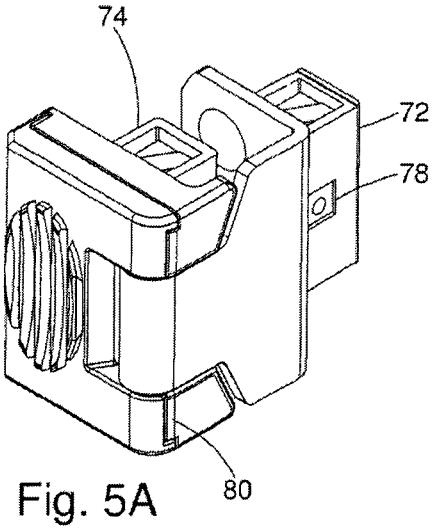
FIGS. 5A and 5B shows corresponding views of a hinge which is fastened by snap fasteners.
Figure 5B:
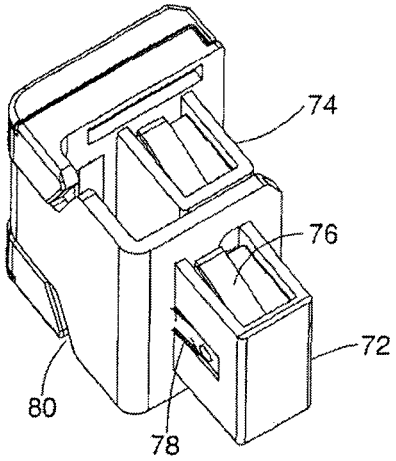

Instead of this, however, the hinge parts formed of metal can also be fastened by means of snap fasteners as is shown in FIGS. 5A and 5B and as shown in the book D-SNAP technology, Verlag moderne Industrie, Munich 2006. The top part 30 has an easy-to-grip surface to facilitate displacement by the thumb and/or index finger. Further, the surface of the top part is provided with grooves 58.

The operation of the hinge according to the invention will now be described in more detail.

FIG. 1 shows the component in closed condition. The contour for opening by hand is knurled so that the thumb or hand does not slip off when attempting to move the top part toward the left-hand side (see arrow 60). While FIG. 1A shows the closed condition of the hinge, FIG. 1B shows the open condition, wherein the door is prevented from falling out by the contour 80 even in the open condition as is shown in FIG. 1B.

In FIG. 1C, the door leaf is swiveled open and the hinge can now be separated (FIG. 1D), while the pin remains in the frame part so as to produce a sturdy and conductive connection which serves to meet the object of electrically connecting the door leaf to the frame. The circuits inside the switch cabinet carry current, and wires can contact the metal door or the frame and accordingly energize the arrangement.

When the door is shut as in FIG. 1C and the hinge is separated as in FIG. 1D, the door can be removed from the frame.

FIGS. 2A, 2B and 2C illustrate the operating principles in the various sliding positions of the slide. In the position shown in FIG. 2A, the top part cannot be displaced farther toward the bottom part due to the contour. FIG. 2B shows the closed condition. The ball 52 continues to rest on an oblique plane 54 under the counterpressure of spring 50 and accordingly provides for a permanent compressive tension. This forces the top part 30 in the direction of the arrow toward the bottom part 28. This tension ensures the required contact between the top part 30 (in connection with the bottom part 28) on the one hand and the pin 20 in the frame part 14 at contact point 82 on the other hand. Contact point 82 is the point of contact of pin 20 in the oblique plane 56 of the hinge part fastened to the door leaf 64.

In this way, it is ensured when the door is mounted and closed that there is a ground connection between the housing or frame 12 on one hand and the metal door leaf 62 on the other hand so that when the operator touches the cabinet there are no disadvantageous consequences if a loose wire inside the cabinet touches the inside of the housing or frame and conducts voltage into the latter.

Figure 4A:
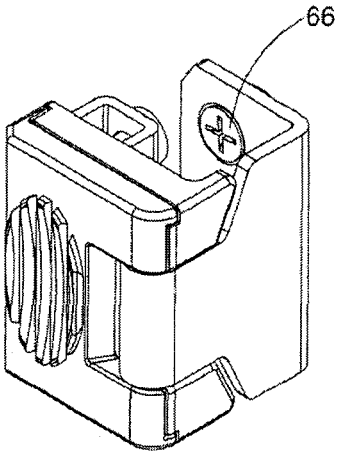
FIGS. 4A and 4B shows two different views of an embodiment form provided for screwing on the hinge.
Figure 4B:
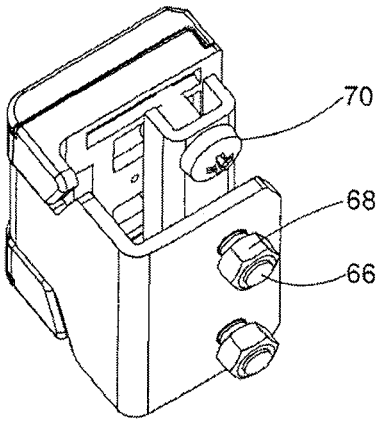

In the embodiment forms in FIGS. 2A to 2F, the two hinge parts are fastened by means of screw nuts—see, for example, reference numerals 66, 68 in FIG. 4A and FIG. 4B.

FIG. 5A and FIG. 5B show an alternative type of fastening. Instead of screw connections as in FIGS. 4A and 4B, designated by reference numerals 66, 68 and 70, snap fastening elements, as they are called, which are designated by reference numerals 72 and 74 and are provided in connection with rectangular openings such as are provided in the thin wall, are fastened in that they are inserted through the openings and possible carriages 76 hold the sheet metal and ensure in this way that the two hinge parts are fastened (see also WO 2005/083207).

COMMERCIAL APPLICABILITY

The invention is commercially applicable in a switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

LIST OF REFERENCE NUMERALS

10 hinge
12 frame

14 first hinge part, fastened to the frame
16 second, U-shaped hinge part, fastened to the door leaf
18 roll
20 hinge pin
22 U-bar
24 U-leg
26 U-leg
28 bottom part
30 top part
32 slide
34 first end position (closed)
36 second end position (open)
38 opening
40 opening
42 end
44 end of the U-leg
46 end of the pin
48 end of the pin
50 spring
52 ball
54 oblique plane for the ball
56 oblique plane for the hinge pin
58 grooves
60 arrow (opening direction)
62 door
64 arrow (tension)
66 fastening screw
68 nut
70 tensioning screw
72 snap fastening instead of screw bolts
74 snap fastening instead of tensioning screw
76 carriage-shaped retaining element
78 grounding spring with scratch toothing
80 contour
82 contact point

The invention claimed is:

1. A hinge for unhingeable sheet-metal cabinet doors, comprising:

a first hinge part configured to be fastened to a door frame, a free end of the first hinge part forming a bore hole or roll through which a hinge pin extends; and a second, U-shaped hinge part configured to be connected to a door, and to surround end areas of the hinge pin that extend from the bore hole or roll when the U-shaped hinge part is mounted to the first hinge part;

wherein the U-shaped hinge part has first U-legs that surround the first hinge part;

wherein the U-shaped hinge part comprises a top part arranged in a bottom part;

wherein the top part has a shape of a U-shaped slide, with second U-legs, arranged in the bottom part so as to be displaceable, parallel to the extension of the first U-legs, between a first end position and a second end position;

wherein, in the first end position, ends of the second U-legs close a lateral outlet opening in the bottom part for the end areas of the hinge pin;

wherein, in the second end position, the ends of the second U-legs expose the lateral outlet opening, allowing the end areas of the hinge pin to pass through the lateral outlet opening when the door is open;

wherein the first and second end positions of the top part are defined by locations where a spring-loaded ball arranged in the bottom part engages with a first oblique plane formed by the top part;

wherein the hinge pin rests on a second oblique plane formed by the bottom part;

wherein a contact point or contact line between the hinge pin and the second oblique plane is under spring pressure that is generated as a force component in direction of a thrust movement;

wherein the spring pressure is generated by the spring-loaded ball, which is provided with a compression spring.

2. The hinge according to claim 1;

wherein the hinge parts are made of metal and are configured to be fastened by screws to the door frame and door, respectively.

3. The hinge according to claim 1;

wherein the hinge parts are made of metal and are configured to be fastened by snap fasteners.

4. The hinge according to claim 1;

wherein only a part of the hinge configured to be fastened to the door frame is made of metal.

5. The hinge according to claim 1;

wherein the top part has grooves to facilitate displacement of the top part by a thumb, a finger, or both.

6. The hinge according to claim 1;

wherein the through-opening has a contour that allows the hinge pin to pass through the through-opening only when the door is partially open.

* * * * *